US011083261B2

(12) United States Patent
Wathne

(10) Patent No.: US 11,083,261 B2
(45) Date of Patent: Aug. 10, 2021

(54) COLLAPSIBLE LUGGAGE

(71) Applicant: TSB LIMITED, New York, NY (US)

(72) Inventor: Soffia G. Wathne, Rye, NY (US)

(73) Assignee: TSB LIMITED, New York, NY (US)

( * ) Notice: Subject to any disclaimer, the term of this patent is extended or adjusted under 35 U.S.C. 154(b) by 305 days.

(21) Appl. No.: 16/083,101

(22) PCT Filed: Dec. 18, 2017

(86) PCT No.: PCT/US2017/066950
§ 371 (c)(1),
(2) Date: Sep. 7, 2018

(87) PCT Pub. No.: WO2018/118750
PCT Pub. Date: Jun. 28, 2018

(65) Prior Publication Data

US 2019/0090602 A1 Mar. 28, 2019

Related U.S. Application Data

(60) Provisional application No. 62/436,227, filed on Dec. 19, 2016.

(51) Int. Cl.
*A45C 5/03* (2006.01)
*A45C 7/00* (2006.01)
*A45C 5/14* (2006.01)

(52) U.S. Cl.
CPC ..... *A45C 7/0036* (2013.01); *A45C 5/03* (2013.01); *A45C 5/14* (2013.01); *A45C 2005/035* (2013.01)

(58) Field of Classification Search
CPC ... A45C 5/14; A45C 2005/035; A45C 7/0036; A45C 5/03
USPC ..... 190/107
See application file for complete search history.

(56) References Cited

U.S. PATENT DOCUMENTS 2,250,126 A * 7/1941 Cross ..... A45C 7/0036 190/107
4,160,496 A * 7/1979 Knight ..... A45C 7/0036 190/107
4,588,056 A 5/1986 Bernbaum
5,749,446 A * 5/1998 Hsieh ..... A45C 7/0022 190/103

(Continued)

FOREIGN PATENT DOCUMENTS

WO 02/45540 A1 6/2002

OTHER PUBLICATIONS

International Search Report and Written Opinion dated Apr. 27, 2018, from International Application No. PCT/US2017/066950, 8 sheets.

*Primary Examiner* — Sue A Weaver
(74) *Attorney, Agent, or Firm* — Katten Muchin Rosenman LLP

(57) ABSTRACT

Disclosed herein is a construction for collapsible luggage which quickly allows the collapsible luggage to be placed in an opened or collapsed state. More specifically, each corner of the collapsible luggage contains a rigid panel which is foldable with respect to a base of the luggage. At least two opposing rigid panels have a corner portion of the panel exposed, allowing those panels to be folded downward first with respect to the other two rigid panels. The zippered top panel for the collapsible luggage can be extended over a top of the collapsible luggage to secure the collapsible luggage in the collapsed position.

13 Claims, 23 Drawing Sheets

(56) References Cited

U.S. PATENT DOCUMENTS

| | | | | |
|---|---|---|---|---|
| 6,401,890 | B1 | 6/2002 | Tan | |
| 6,533,087 | B1 * | 3/2003 | Chen | A45C 7/0022 190/103 |
| 7,175,061 | B2 * | 2/2007 | Dohn | A45F 5/02 224/241 |
| 2002/0084159 | A1 * | 7/2002 | Hamlin | A45C 7/0077 190/107 |
| 2002/0125089 | A1 | 9/2002 | Davis et al. | |
| 2005/0034948 | A1 * | 2/2005 | Tiramani | A45C 7/0022 190/107 |
| 2006/0169690 | A1 * | 8/2006 | Rothschild | A45C 7/0036 220/7 |
| 2013/0075213 | A1 | 3/2013 | Chi Yueh Chen et al. | |
| 2016/0122171 | A1 * | 5/2016 | Kim | B67D 1/08 222/173 |
| 2019/0328097 | A1 * | 10/2019 | Kao | A45C 5/14 |

* cited by examiner

COLLAPSIBLE LUGGAGE

CROSS-REFERENCE TO RELATED APPLICATION

The present application claims priority to U.S. Provisional Application Ser. No. 62/436,227, filed Dec. 19, 2016, the entire contents of which are hereby incorporated by reference in their entirety.

FIELD OF THE INVENTION

The present invention provides collapsible luggage having a reduced thickness for easier storage.

BACKGROUND

Various types of luggage, from rolling luggage to duffel bags, are well known. A primary problem with most types of luggage is that they are only typically only used a few times a year and take up much space. There have been attempts to solve the space that luggage takes up in the past. For example, some luggage is sold in different sizes that "nest" within each other. This, however, requires the purchase of multiple pieces of luggage to be an effective solution. Others have also attempted to design rigid, yet collapsible, luggage which takes up less space in the collapsed state. However, many of these solutions utilize complicated mechanisms which may become broken over time. Therefore, a need clearly exists for collapsible luggage that utilizes a simple, but rugged, mechanism for maintaining the luggage in collapsed and opened positions.

SUMMARY

The present invention provides a construction for collapsible luggage which quickly allows the collapsible luggage to be placed in an opened or collapsed state. More specifically, each corner of the collapsible luggage contains a rigid panel which is foldable with respect to a base of the luggage. At least two opposing rigid panels have a corner portion of the panel exposed, allowing those panels to be folded downward first with respect to the other two rigid panels. The zippered top panel for the collapsible ling age can be extended over a top of the collapsible luggage to secure the collapsible luggage in the collapsed position.

DETAILED DESCRIPTION

Figure 1A:
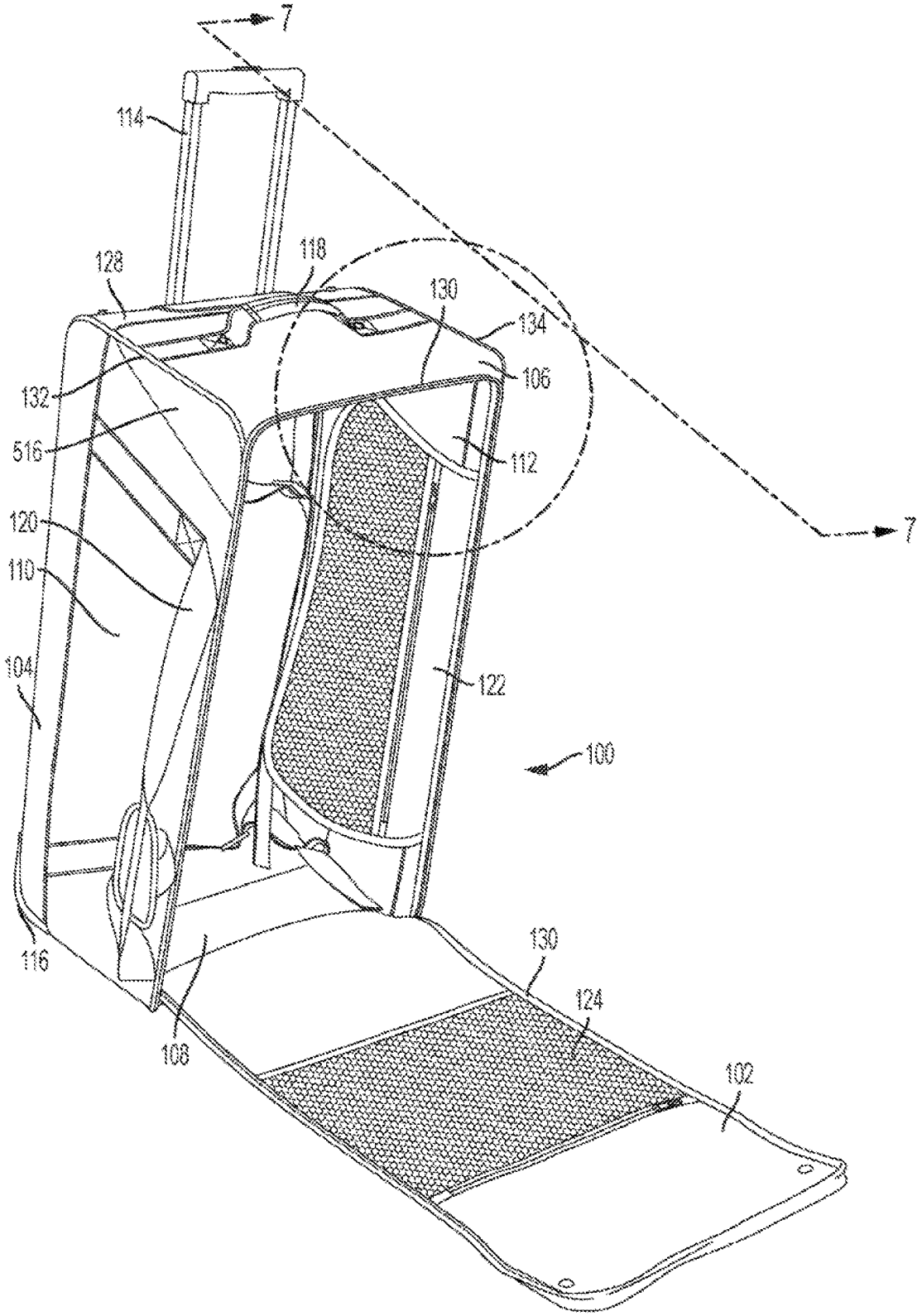
FIGS. 1A and 1B depict perspective views of a first embodiment of the collapsible luggage in an opened state before collapsing.
Figure 1B:
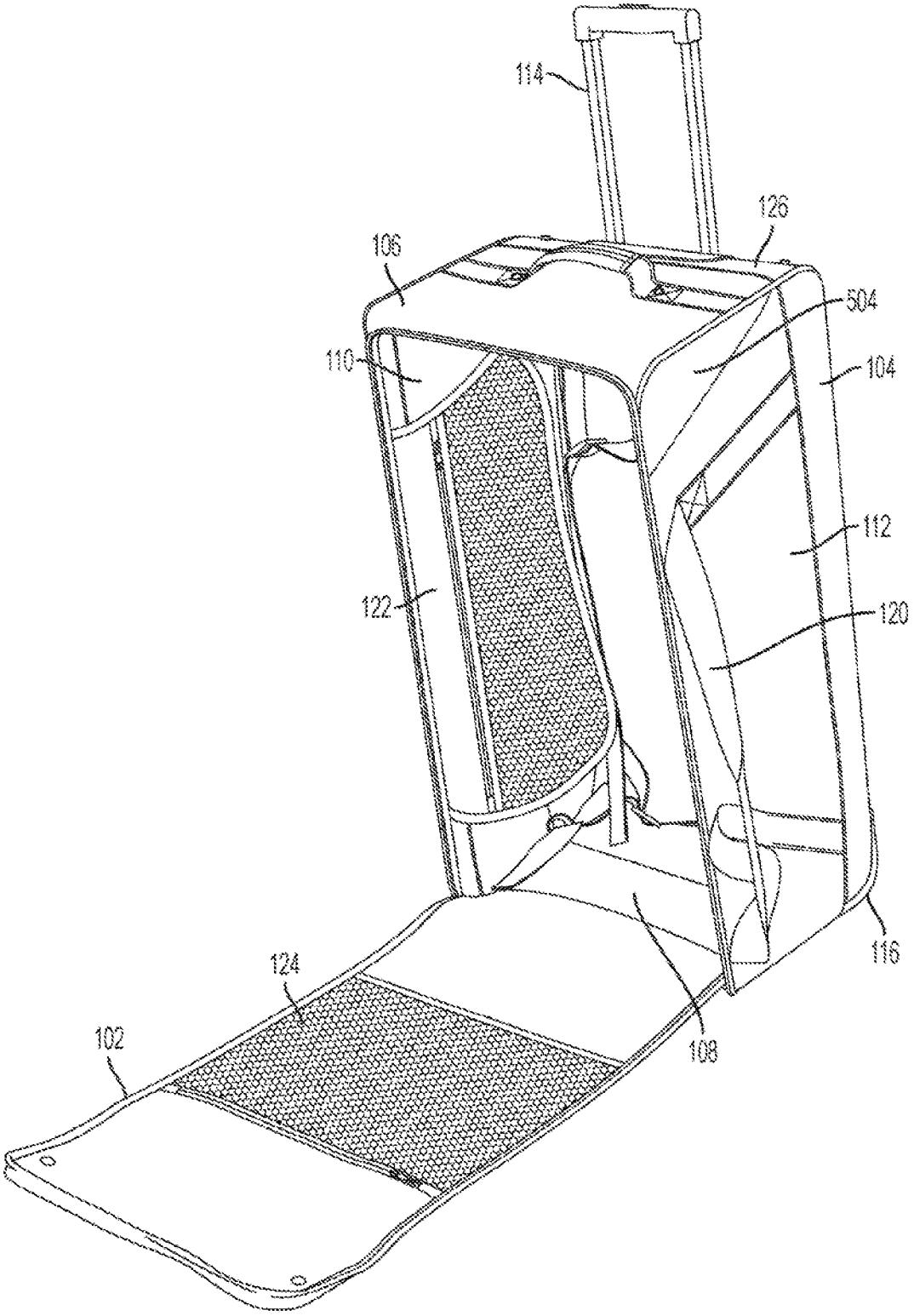

FIGS. 1A and 1B depict left and right perspective views of a first embodiment of collapsible luggage 100 in an open state before collapsing. Collapsible luggage 100 generally comprises cover 102, rigid base 104, and sides 106, 108, 110, and 112. As will be explained later, sides 106 and 108 are substantially in construction to each other as are sides 110 and 112.

Rigid base 104 may include standard luggage features such as retractable handle 114, wheels 116, zippered pockets, etc., as are known in the art. Side 106 may comprise handle 118 to carry collapsible luggage 100. Similarly, sides 110 and 112 may contain straps 120 which can be used together to carry collapsible luggage 100. The interior of collapsible luggage 100 may also comprise a number of pockets and/or storage elements such as compartments 122 attached along a top portion of sides 110 and/or 112 (e.g., to provide compartmentalized storage) or zippered compartment 124 on cover 102. It should be obvious to one of ordinary skill in the art that any of these external carrying features or compartments can be modified or removed without affecting the collapsing of collapsible luggage 100.

Rigid base 104 is formed from a reinforced back forming a back of collapsible luggage 100 luggage having sidewall 126 extending upward therefrom around the periphery of the reinforced back. Preferably, a thickness of sidewall 126 is minimized to allow sides 106-112 to collapse therein, allowing for maximum compressibility. Or, if collapsible luggage 100 comprises wheels 116, sidewall 126 should be thick enough to accommodate wheels 116. However, if additional strength is desired for luggage 100, sidewall 126 can be made slightly thicker or even reinforced.

Rigid base 104 can be formed from a molded plastic or rigid metal material and covered with an abrasion resistant fabric, similar to that used on sides 106-112 or cover 102. Sides 106-112 are joined to sidewall 126 in a hinged manner, allowing the collapsible luggage 100 to collapse as will be described with reference to FIGS. 2A-4B.

In the opened state, depicted in FIGS. 1A and 1B, cover 102 is joined to a top edge of side 108 via stitching or any other known method. Generally, cover 102 is formed from a flexible piece of material having zipper 130 extending around three sides of cover 102 which mates with a corresponding zipper 130 located on top portions of sides 106, 110, and 112 as depicted. A lower portion of cover 102 may comprise an internal panel to provide some rigidity to the cover. For example, the rigid panel of cover 102 may extend from the top portion of side 108 to the top of zippered compartment 124. Only the top portion of cover 102, which connects to side 106, needs to remain flexible as will be shown later. When closed, the zipper 130 maintains the luggage in a fully opened position and prevents sides 106-112 from collapsing.

Sides 106 and 108 each contain an internal panel (which is covered by a fabric cover and not shown) and is preferably a hard plastic material or a carbon board. The rigid panel in sides 106 and 108 is sized to be substantially the same size as the side. For example, in side 106, the internal panel would extend from hinge 128 to zipper 130 in a first direction and from seam 132 to seam 134 in a second direction.

The internal panel provides structural support for sides 106 and 108 and is covered on both sides by a fabric cover.

Generally, the internal panel is square or rectangular as is dictated by the desired configuration of collapsible luggage 100. For example, in collapsible luggage 100 depicted in FIGS. 1A and 1B, the internal panels for sides 106 and 108 would be rectangular. The fabric cover of sides 106 and 108 surrounding the internal panel is attached to sidewall 126 (e.g., through stitching). For example, the connection of the fabric cover of side 106 to sidewall 126 by stitching forms hinge 128. Because the internal panel is not connected to sidewall 126 (only the fabric cover is), sides 106 and 108 can move in a hinge-like manner with respect to sidewall 126 as will be described and shown later.

Figure 5:
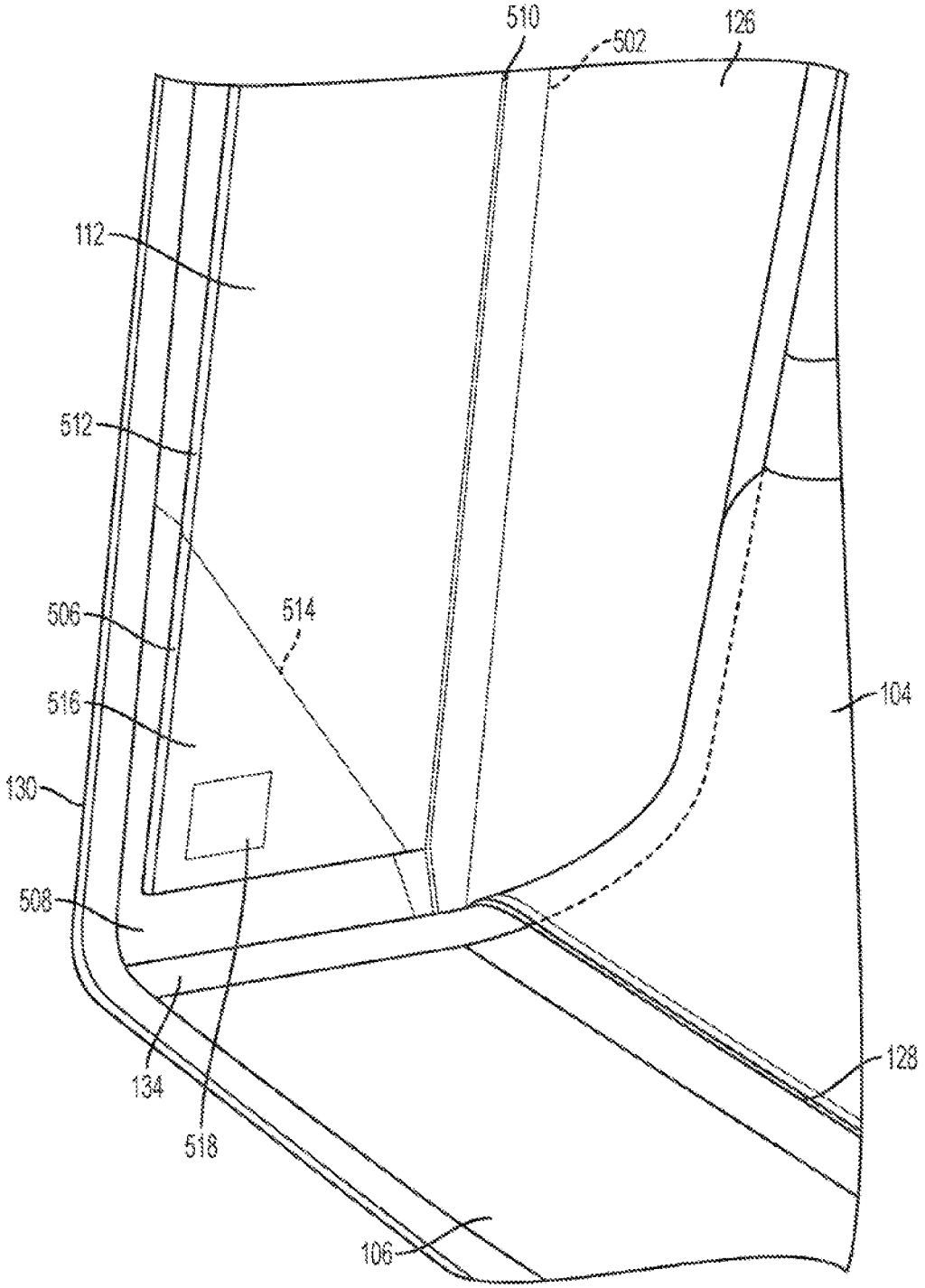
FIG. 5 depicts an interior view coda corner of the collapsible luggage.

Sides 110 and 112 each contain a panel 506 formed from a hard plastic material or carbon board, similar to that within sides 106 and 108. FIG. 5 depicts an internal view of collapsible luggage 100 showing the connection between sides 106 and 112 along seam 134. The corner views of the connection between sides 108 & 112, sides 108 & 110, and sides 106 & 110 is substantially similar to that depicted in FIG. 5 described below. In this view, compartment 122, attached to side 112, is not depicted for clarity.

FIG. 5 better shows how side 106 is connected to sidewall 126 along hinge 128. Similarly, side 112 is connected to sidewall 126 along hinge 502. Fabric cover 508 forms an exterior portion of side 112. Fabric cover 508 is preferably an abrasion resistant material such as ballistic nylon. However, it should be obvious to one of ordinary skill in the art that fabric cover 508 may be any material known for use in construction luggage.

Along an interior of collapsible luggage 100, an entire bottom portion of panel 506 is coupled to fabric cover 508 along seam 510, preferably by stitching. Panels 506 may also be sandwiched between fabric cover 508 and an interior fabric cover so that the majority of panel 506 is not visible.

In some embodiments, the majority of a top portion of panel 506 may also be joined to fabric cover 508 by stitching along seam 512, The ends of panel 506 are joined to fabric cover 508 along diagonal seam 514, leaving triangular end 516 of panel 506 not connected to fabric cover 508. As should be obvious to one of ordinary skill in the art, the angle of diagonal seam 516 depends upon the heights of sides 106-112 as will he shown later (e.g., to allow collapsing).

Panel 506 is rectangular in this embodiment and has a height extending from seam 510 to approximately just under zipper 130. Panel 506 has a length extending from approximately seam 134 to a similar seam connecting sides 108 and 112. Preferably, panel 506 has a length such that triangular ends 516 can easily move away from fabric cover 508 without catching or interfering with seam 134.

Preferably, an exterior of each triangular end 516 (four total in this embodiment) have first connector 518 which mates with a corresponding second connector 520 on an interior of fabric cover 508. In the opened state, the mating of first connector 518 with second connector 520 maintains the collapsible luggage 100 in the opened position prior to the closing of cover 102, making loading and unloading of collapsible luggage 100 easier.

Figure 6:
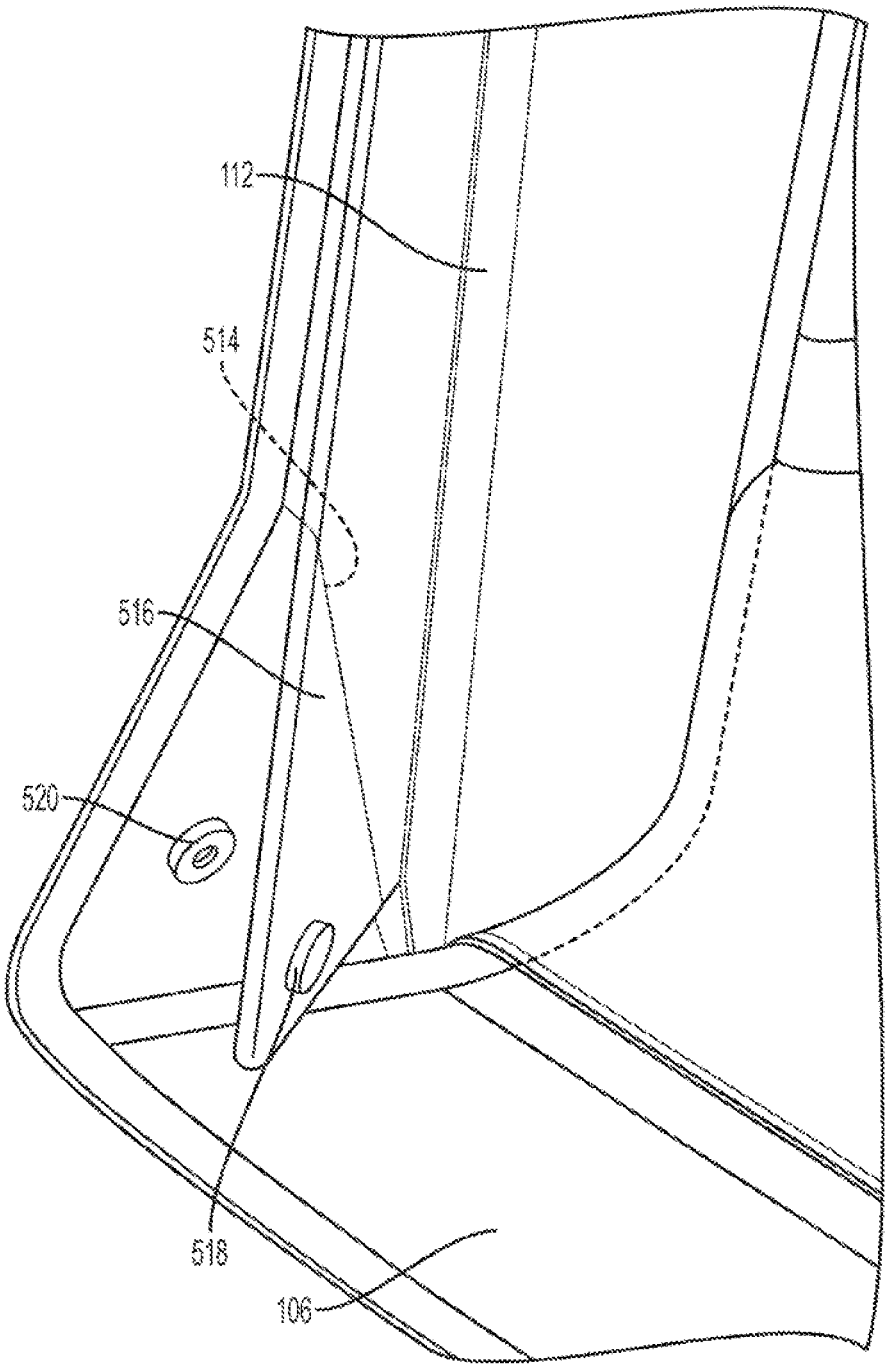
FIG. 6 depicts an alternate embodiment of the corner of the collapsible luggage.

First connector 518 and second connector 520 may be any known type of quick release mating connectors such as hook and loop fasteners, buttons, clips, etc. The embodiment depicted in FIG. 5 shows hook and loop fasteners being used as first connector 518 and second connector 520. In another embodiment, depicted in FIG. 6, a button closure is shown as first connector 518 and second connector 520. It should be obvious that any combination of type of connectors may be utilized in the present invention at any of the four corners of collapsible luggage 100.

Figure 2A:
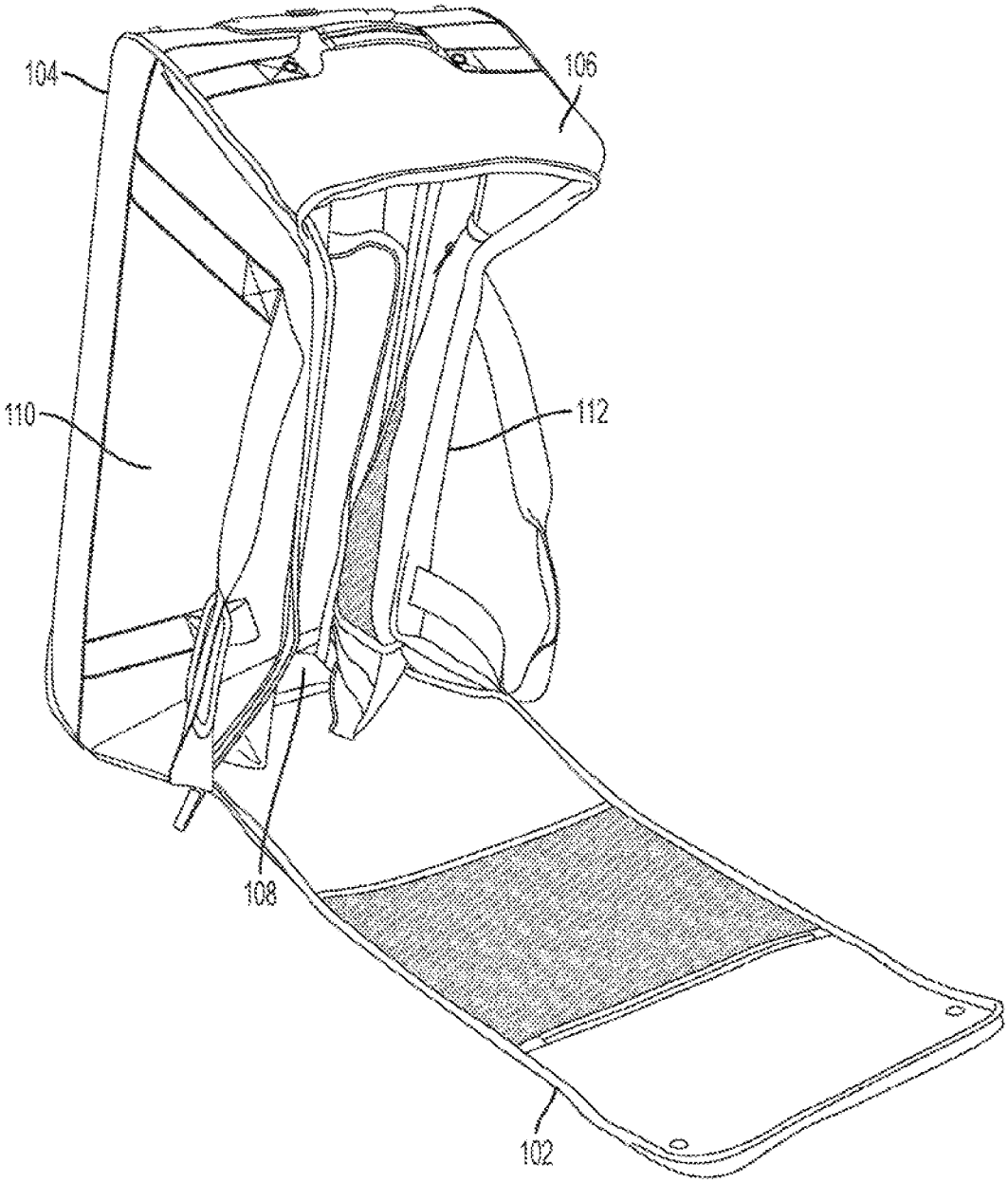
FIGS. 2A-4B depict the collapsible luggage in various states of collapse, depicts the sides of the luggage of FIG. 1 partially collapsed.
Figure 2B:
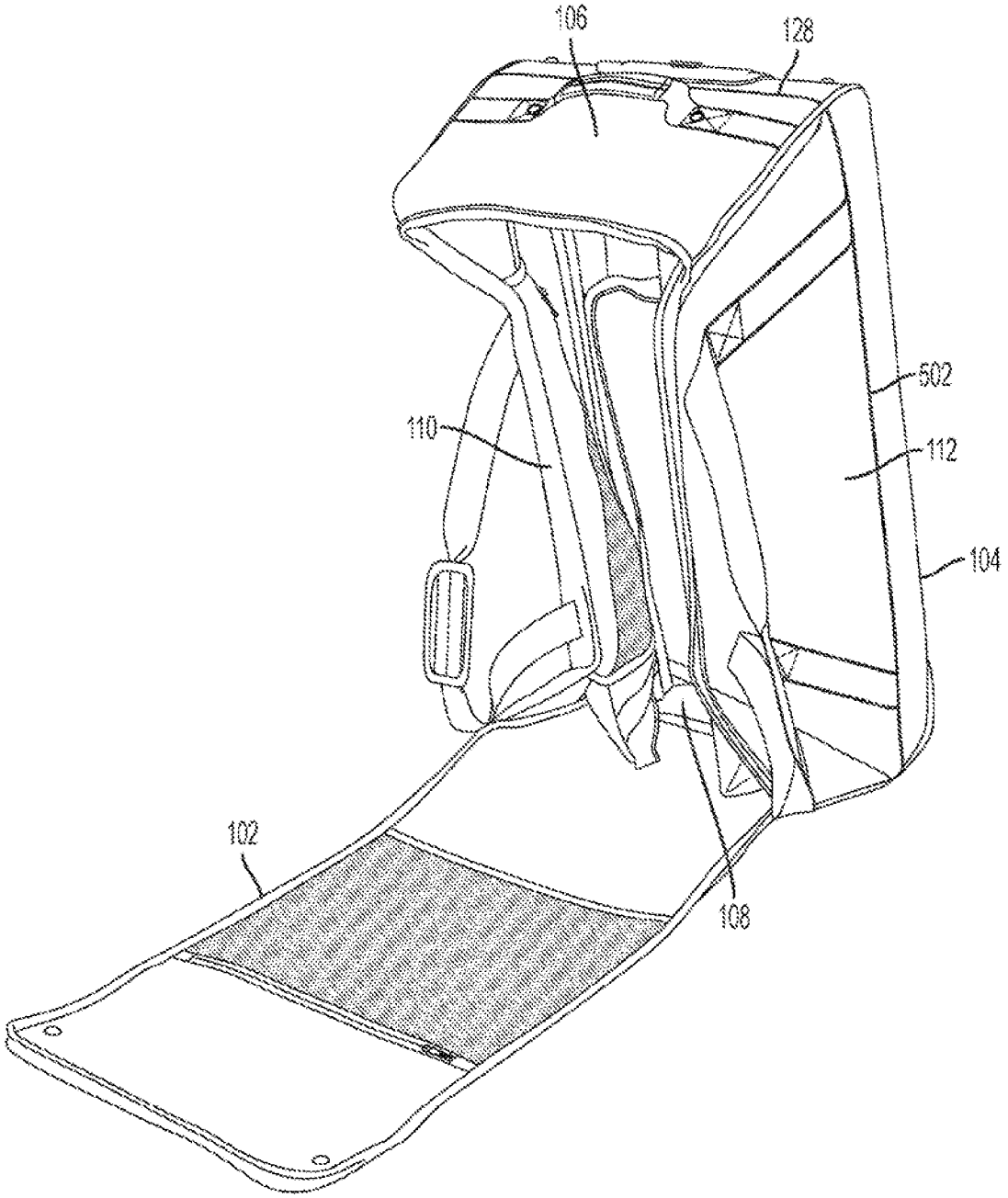
Figure 3A:
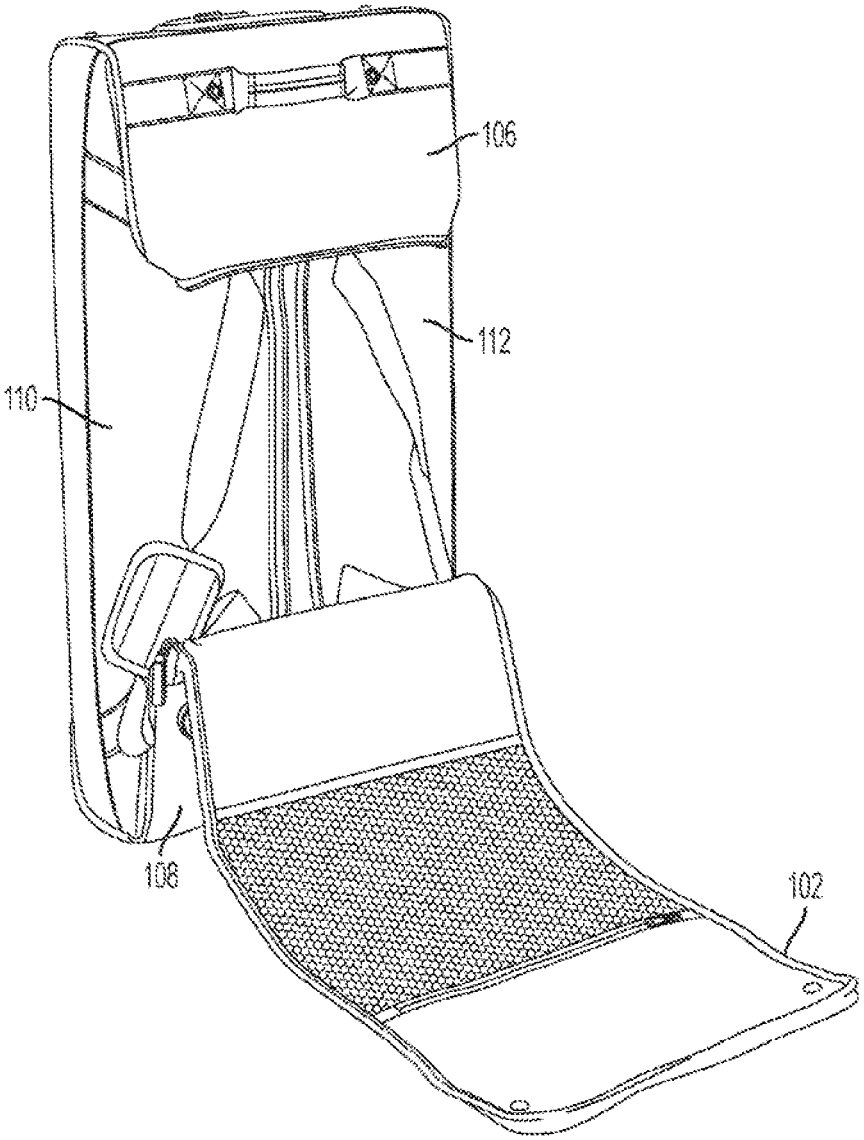
Figure 3B:
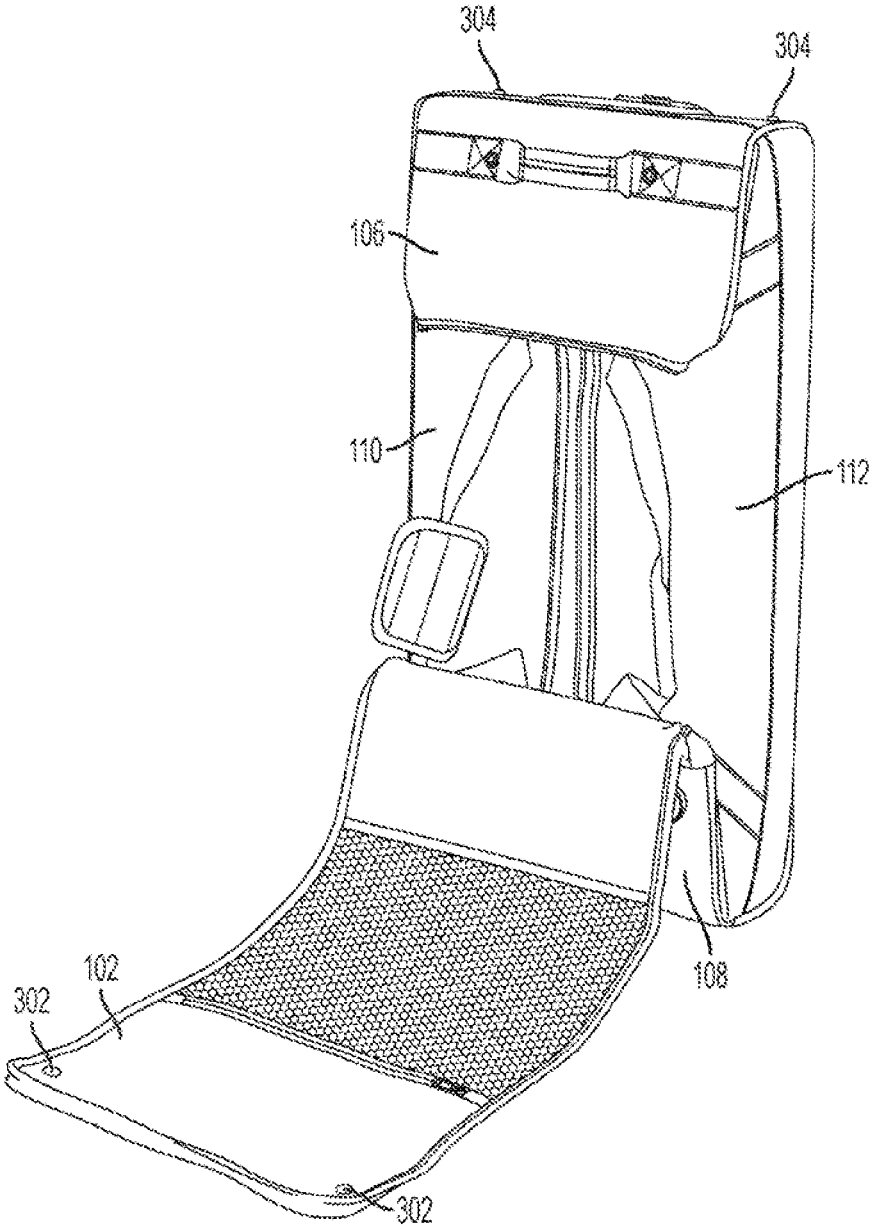

The steps utilized to collapse collapsible luggage 100 will now be described with respect to FIGS. 2A-4B. First as depicted in FIGS. 2A-2B, the sides 110 and 112 are pressed inward towards a center of collapsible luggage 100 and rotate about their respective hinges (e.g., 112 rotates inward about hinge 502). This causes triangular ends 516 to be moved away from fabric cover 508 as will be described later. Because the fabric cover 508 is not attached to the triangular ends 516 of sides 110 and 112 at the corners, sides 110 and 112 can be partially collapsed before sides 106 and 108 are collapsed as shown in FIGS. 3A-3B. If snap connectors are used as first connector 518 and second connector 520, they may need be unmated before sides 110 and 112 can be pressed inward.

As shown in FIGS. 3A and 3B, sides 110 and 112 are able to collapsed and be retained within sidewall 126 while sides 106 and 108 rest on top of sides 110 and 112 as they are folded inward. Cover 102 further comprises first connectors 302 which mate with second connectors 304 on sidewall 126.

Figure 4A:
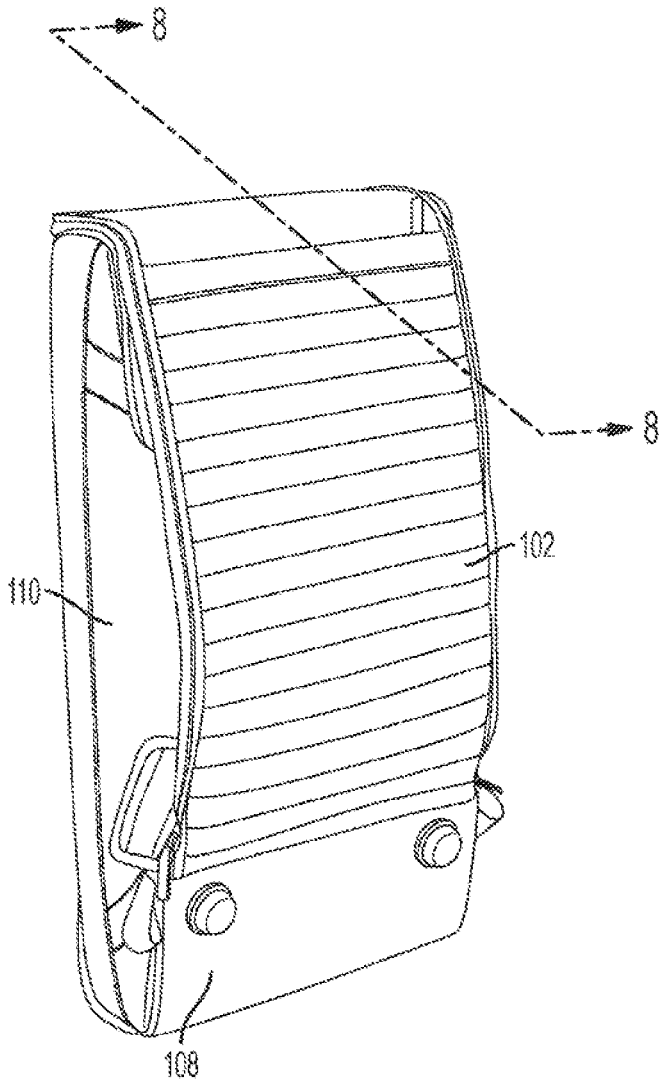
Figure 4B:
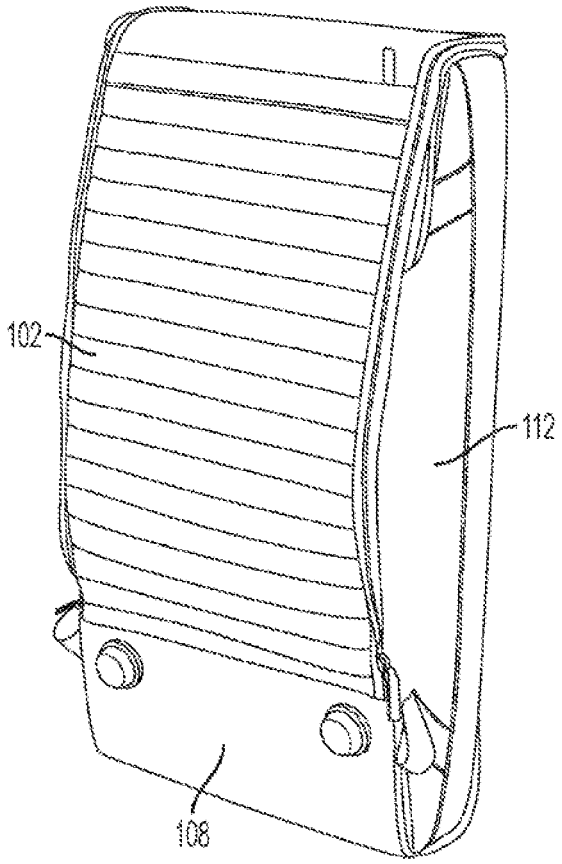
Figure 8:
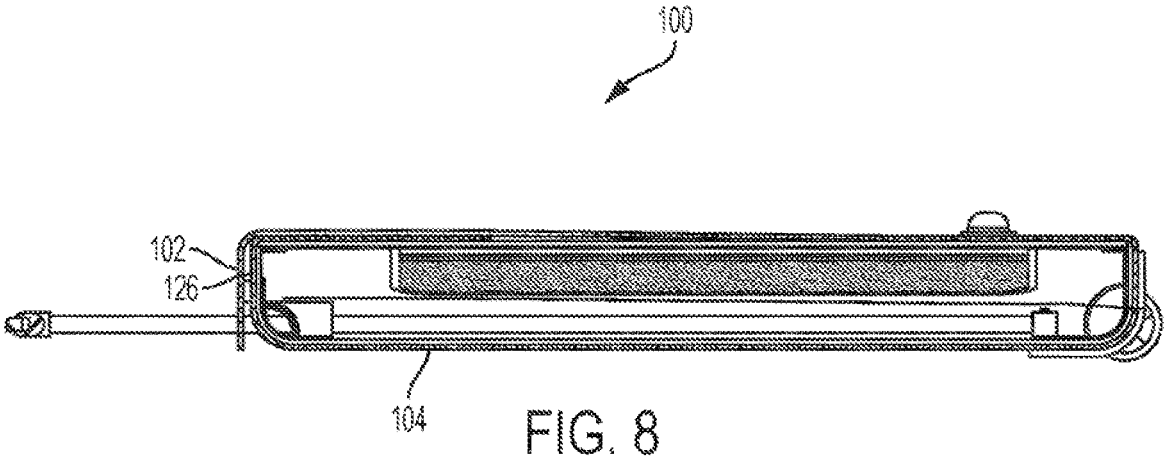
FIG. 8 depicts a cross-sectional view of the luggage of FIG. 4A taken along the dotted line.

The inward folding of side 108 allows cover 102 to be folded over sidewall 126 so that first connectors 302 can mate with second connectors 304 on sidewall 126 as shown in FIGS. 4A and 4B. Because sidewall 126, the sides 110 and 112 can actually fold down past horizontal and into the collapsible luggage 100, allowing sides 106 and 108 to fold completely horizontal. Thus, when fully collapsed, the collapsible luggage 100 can be made completely flat as depicted in FIG. 8. This allows for easier stacking of the luggage as there is no "bulge" and multiple pieces of collapsible luggage 100 can easily be placed on top of each other.

The outside of cover 102 may be formed from a baffled construction. The baffles are effective for holding any internal padding which allows cover 102 to remain semi-rigid. Alternative baffle designs, such as a checker-square pattern may also be utilized. The sewing lines that form the baffles allow cover 102 to fold along the seams, preventing the fabric from wrinkling. This also helps to maintain the structural integrity of collapsible luggage 100 when it is fully expanded. Cover 102 also secures straps 120 under cover 102. To open the collapsible luggage 100, cover 102 is first unsecured and the folding process depicted in FIGS. 2A-4B is reversed.

Figure 7:
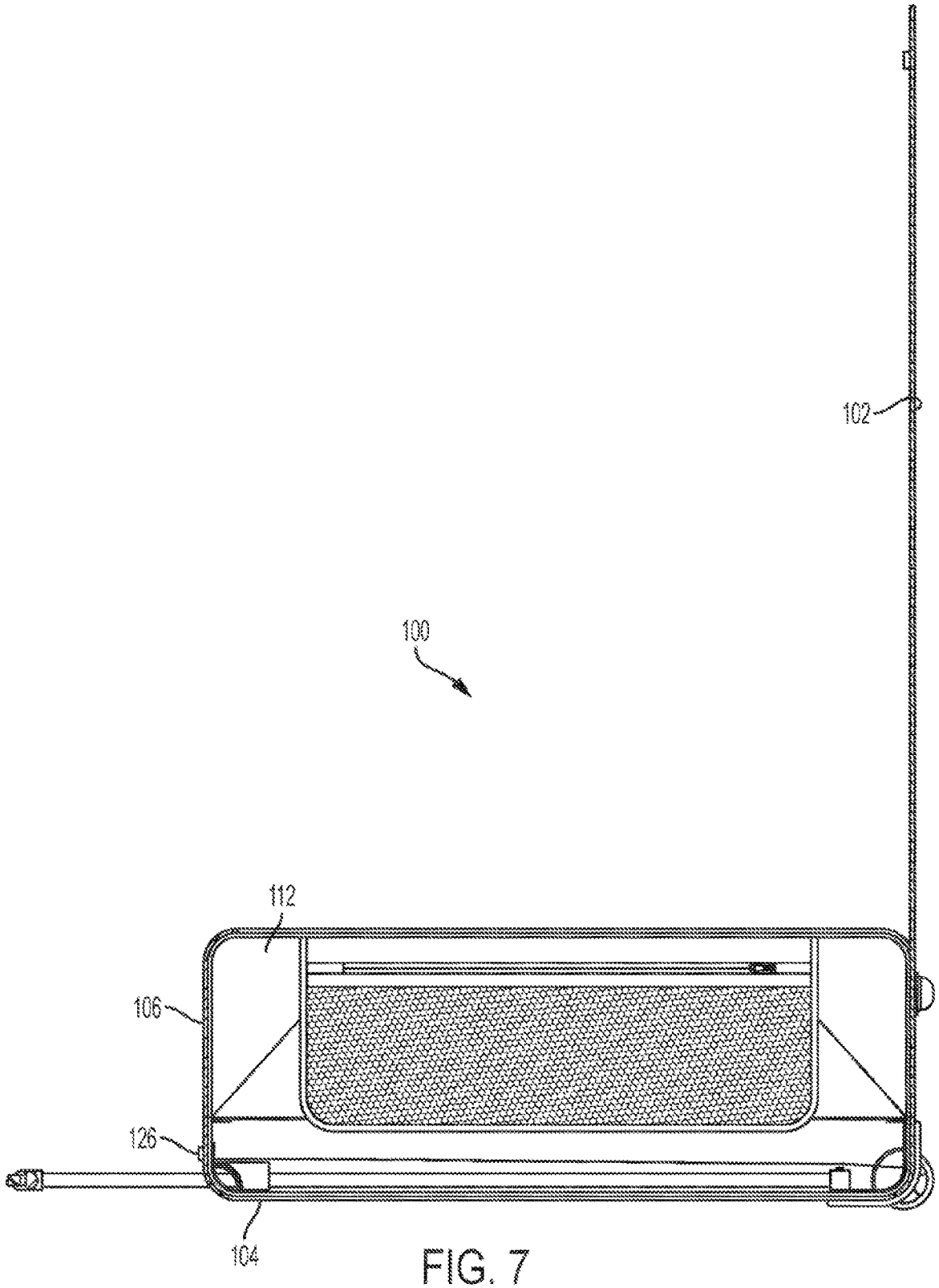
FIG. 7 depicts a cross-sectional view of the luggage of FIG. 1A taken along the dotted line.

FIG. 7 depicts a cross-sectional view of FIG. 1A taken along the dashed line and FIG. 8 depicts a cross-sectional view of FIG. 4A taken along the dashed line. The difference between FIGS. 7 and 8 shows the great reduction in thickness of the luggage achieved in the present invention. Specifically, FIG. 8 shows that the luggage may be collapsed to less than ⅓ of its original thickness depicted in FIG. 7. Further, unlike other pieces of collapsible luggage that currently exist, the collapsible luggage 100 is securely maintained in the collapsed state through the use of first connectors 302 and second connectors 304. For example, a hanger hook, or other mechanism could be placed on sidewall 126 and collapsible luggage 126 could be hung from a closet bar in its collapsed state in a closet alternatively to being stored under a bed or on the ground.

Figure 9:
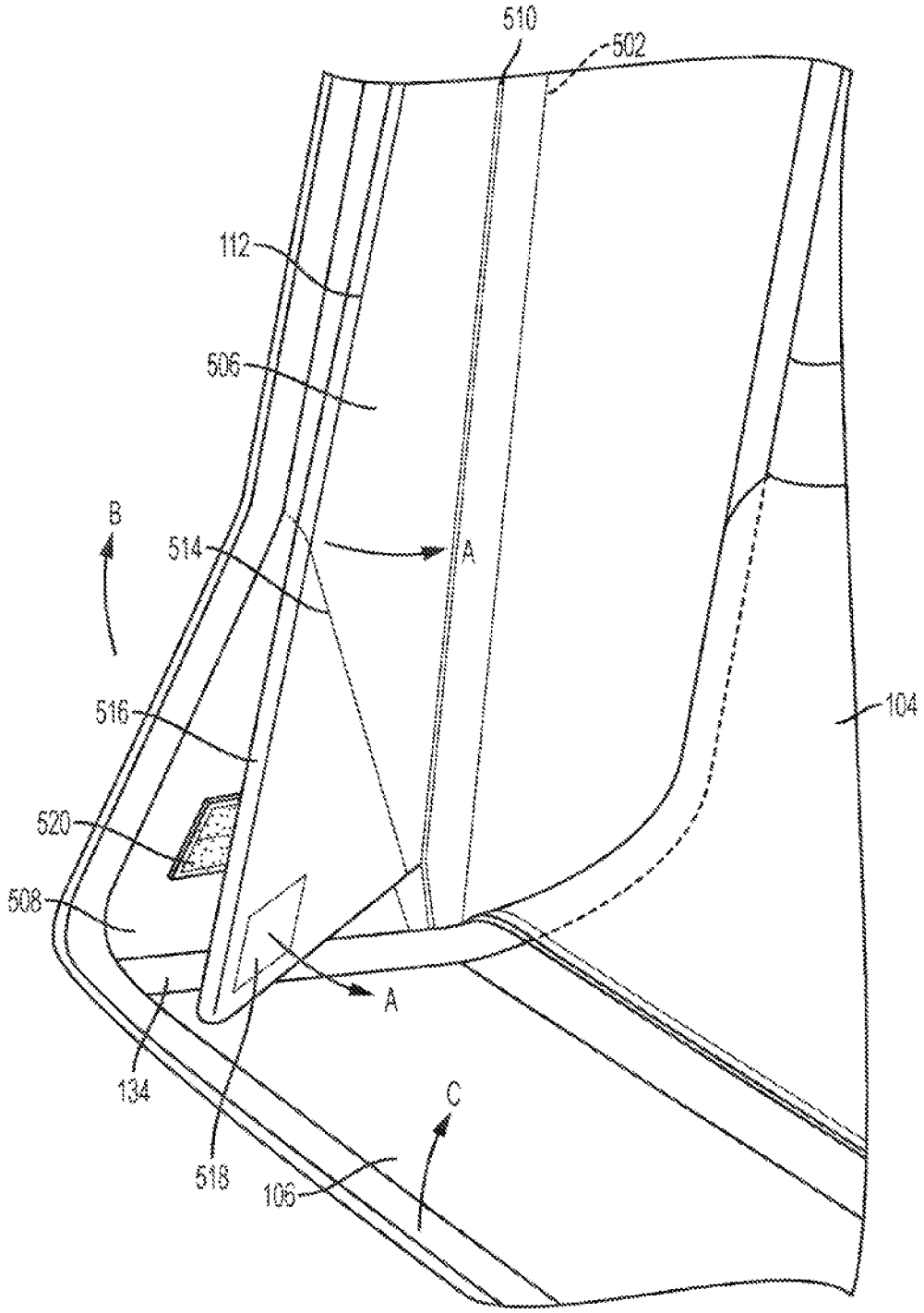
FIGS. 9-15 depict the corner of FIG. 6 in various states of collapse.
Figure 10:
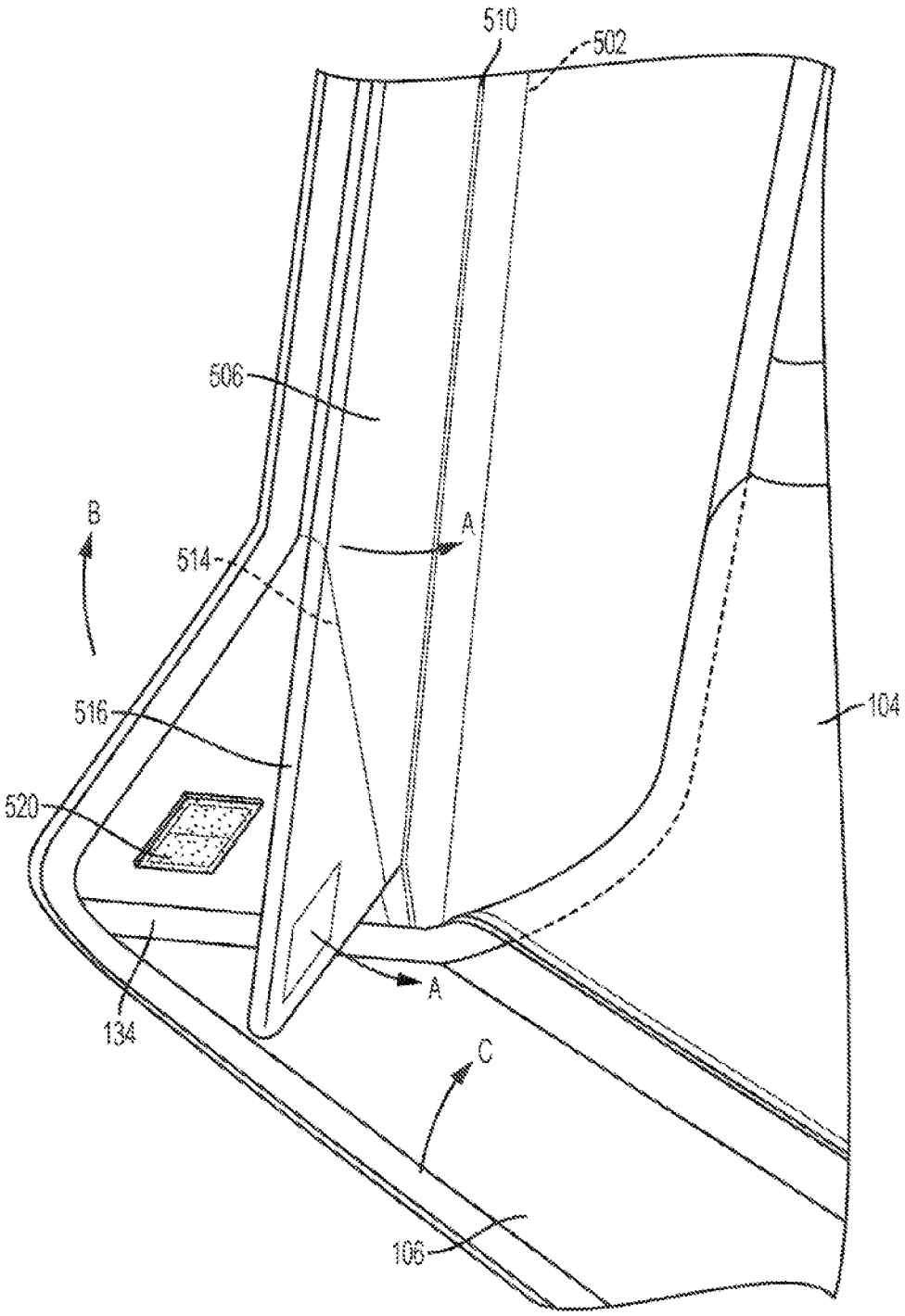
Figure 11:
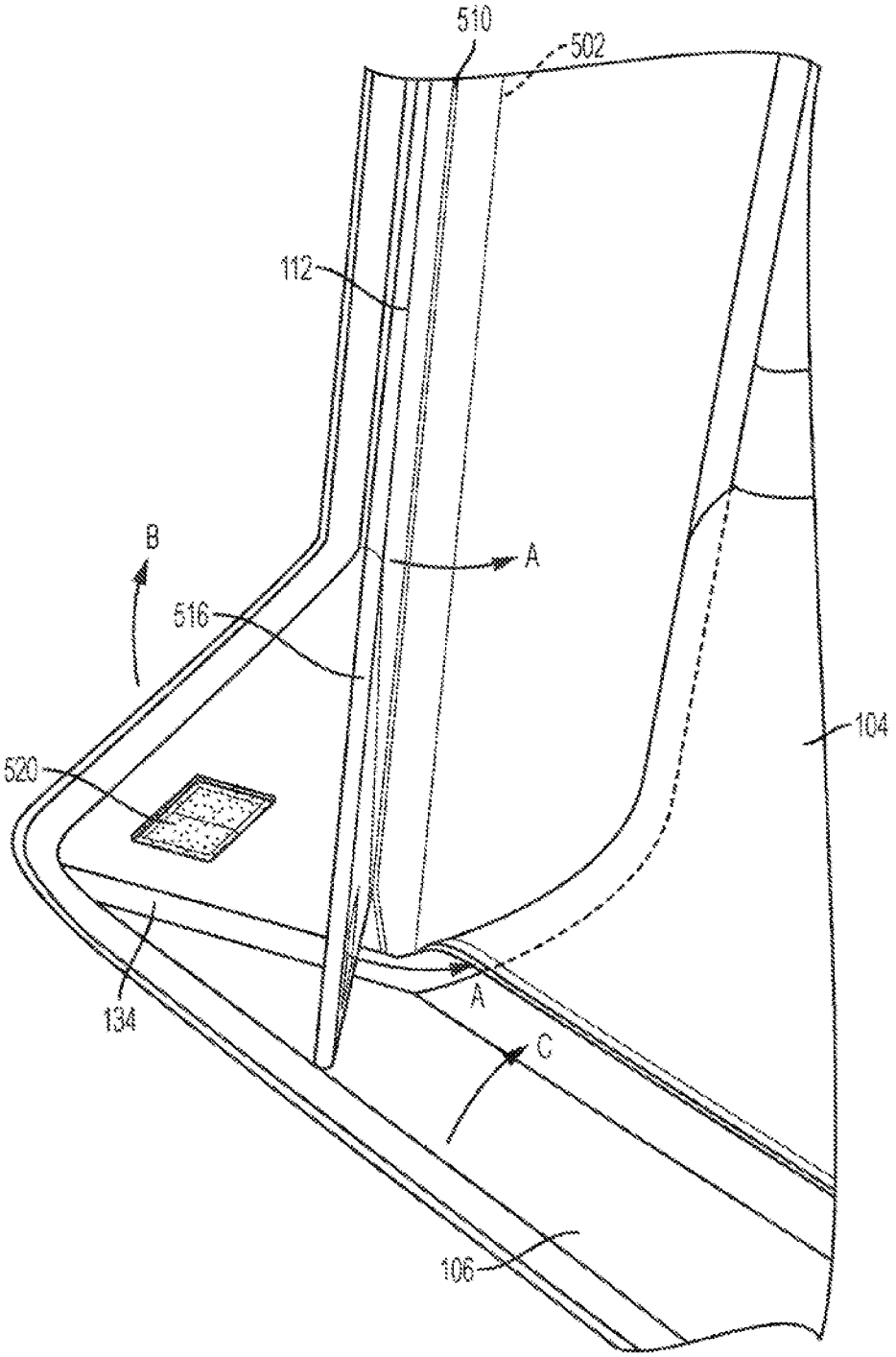
Figure 12:
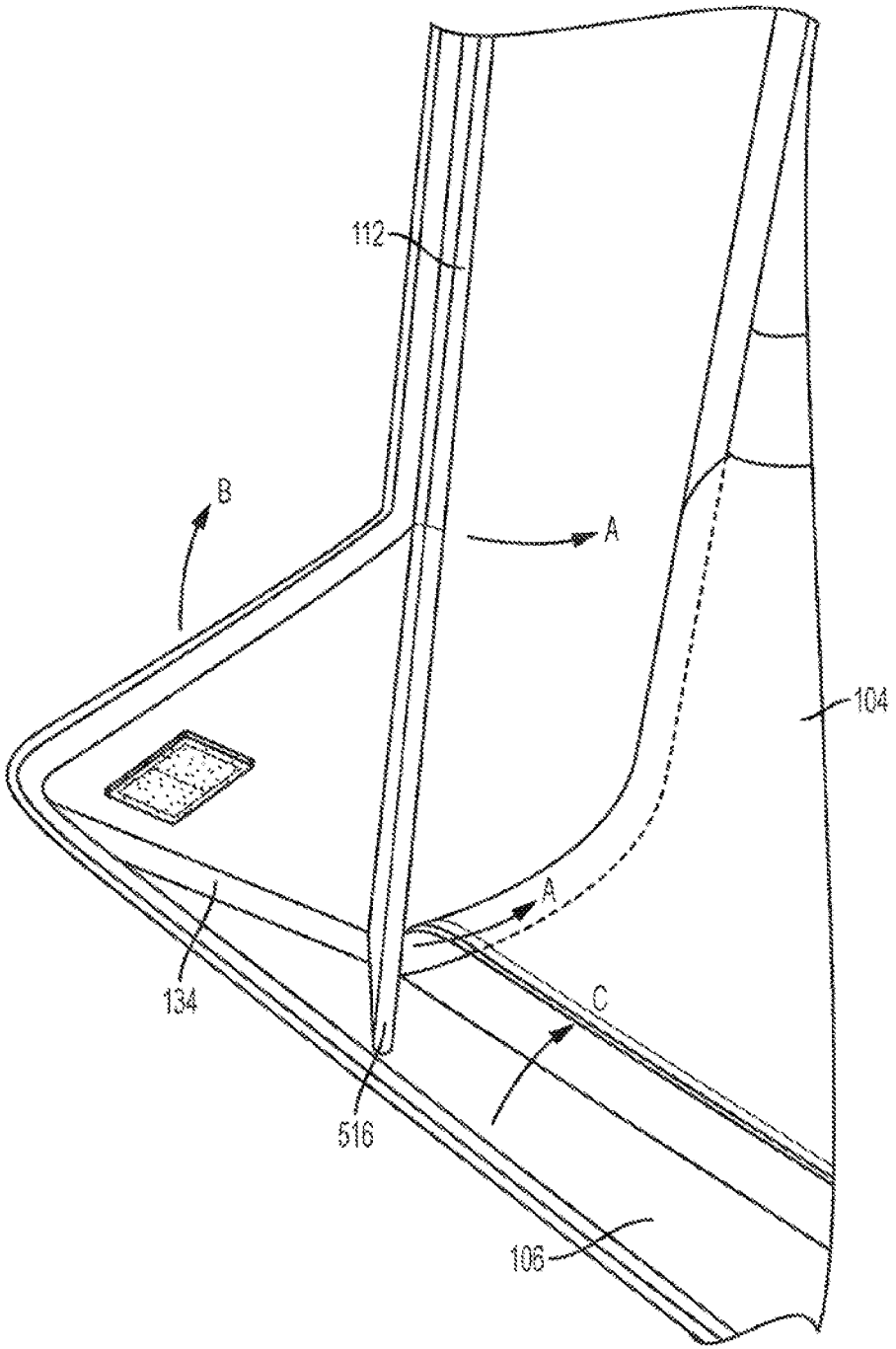
Figure 13:
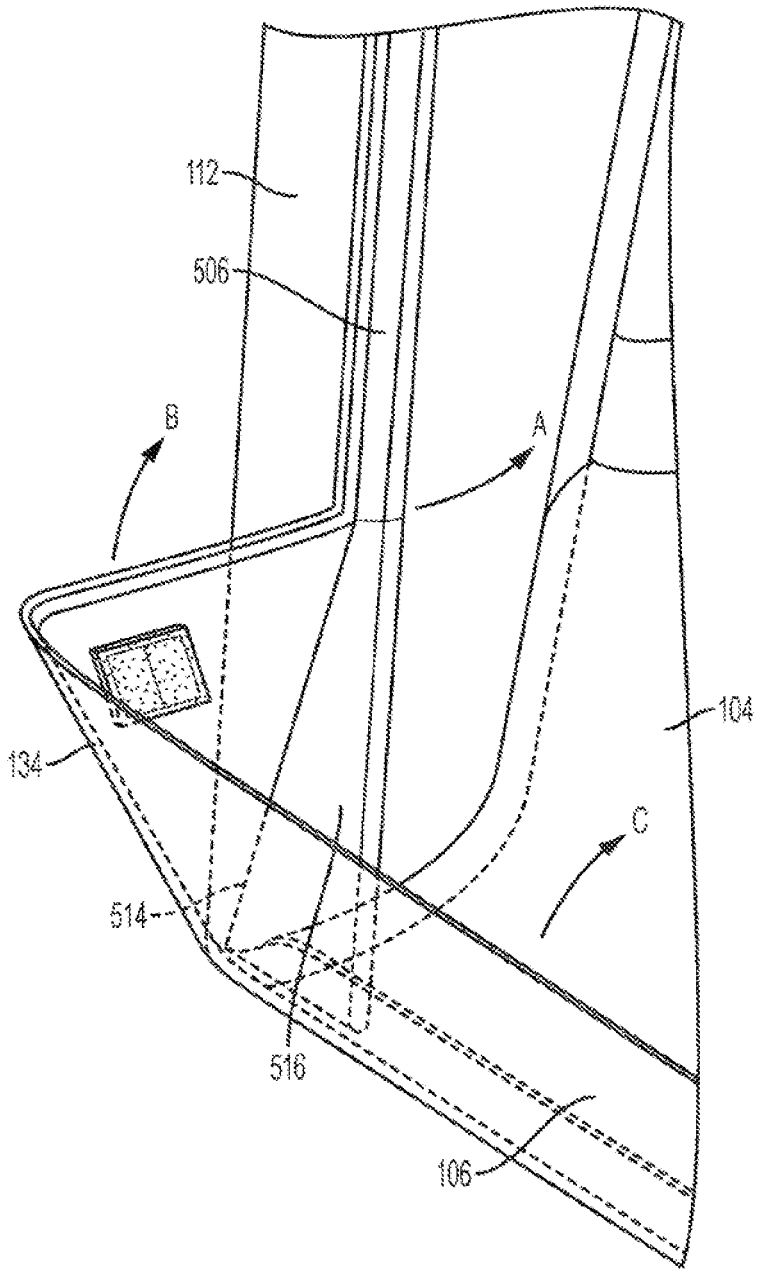
Figure 14:
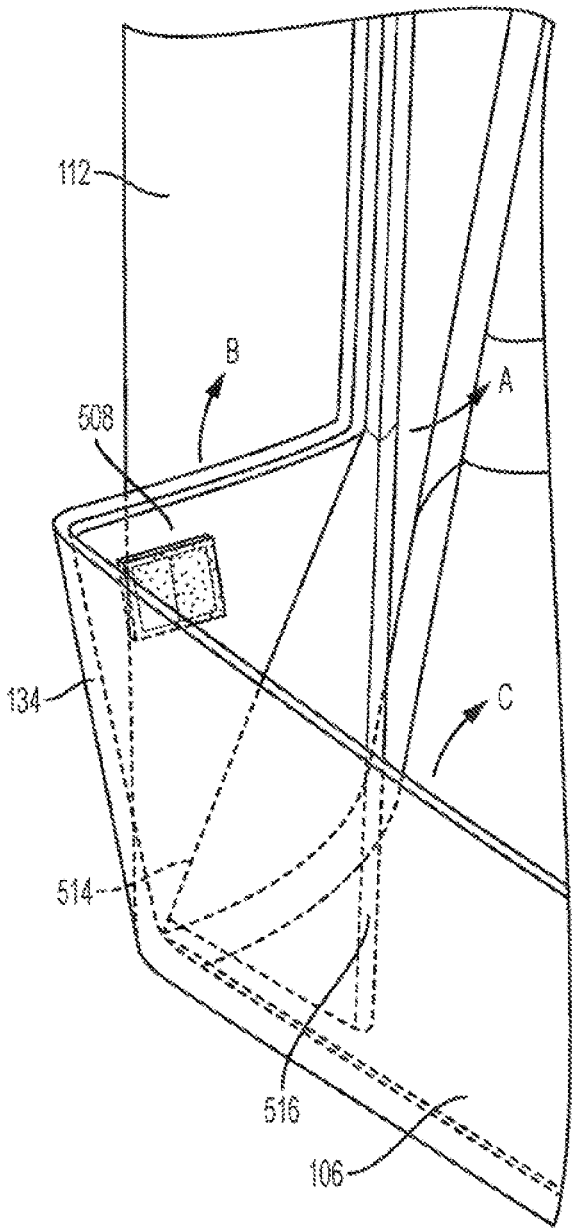
Figure 15:
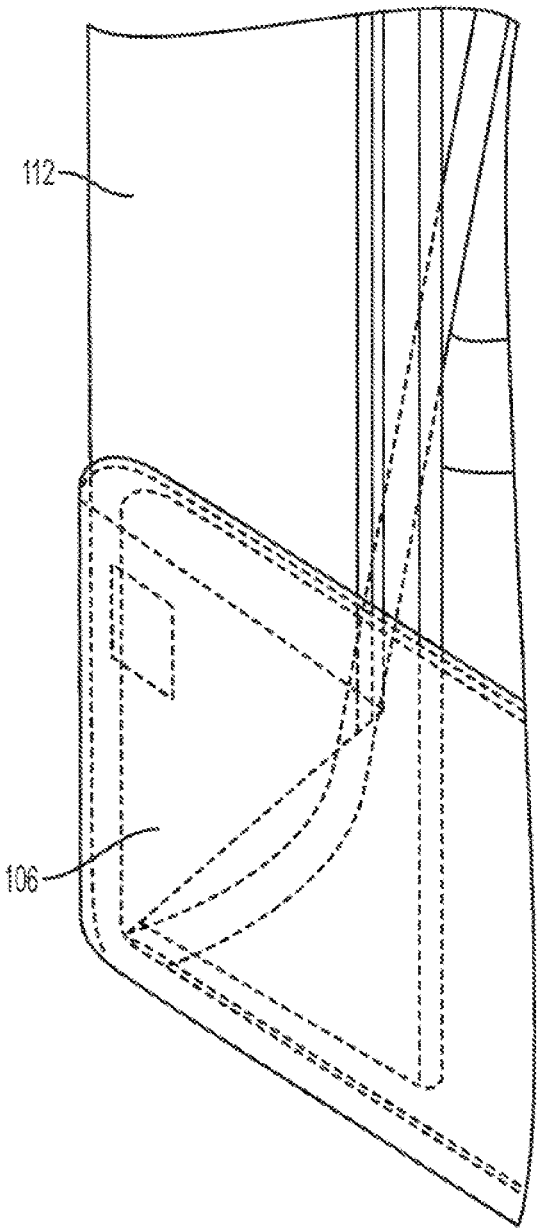
Figure 16:
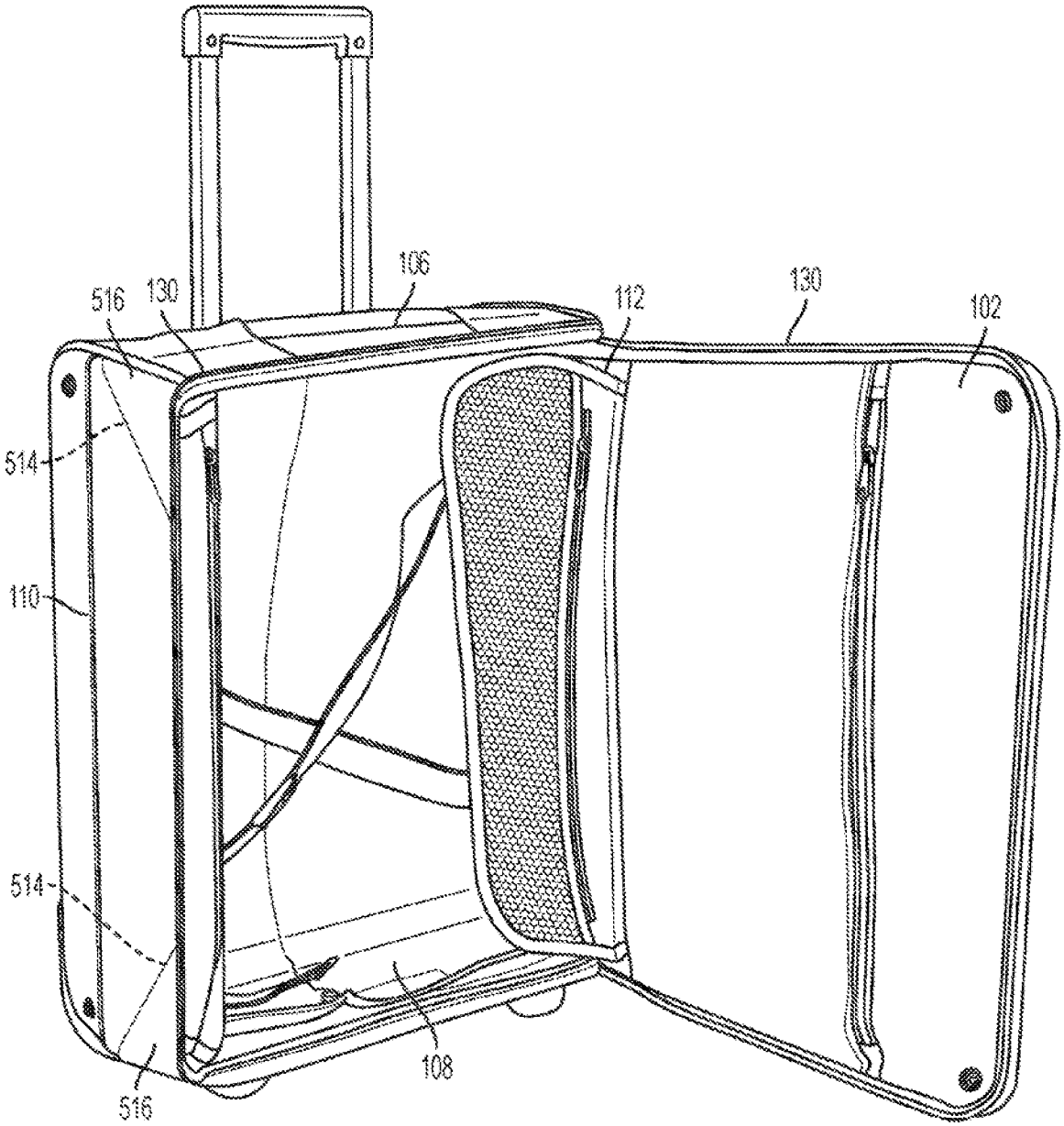
FIGS. 16-19 depict perspective views of a second embodiment of the collapsible luggage.
Figure 17:
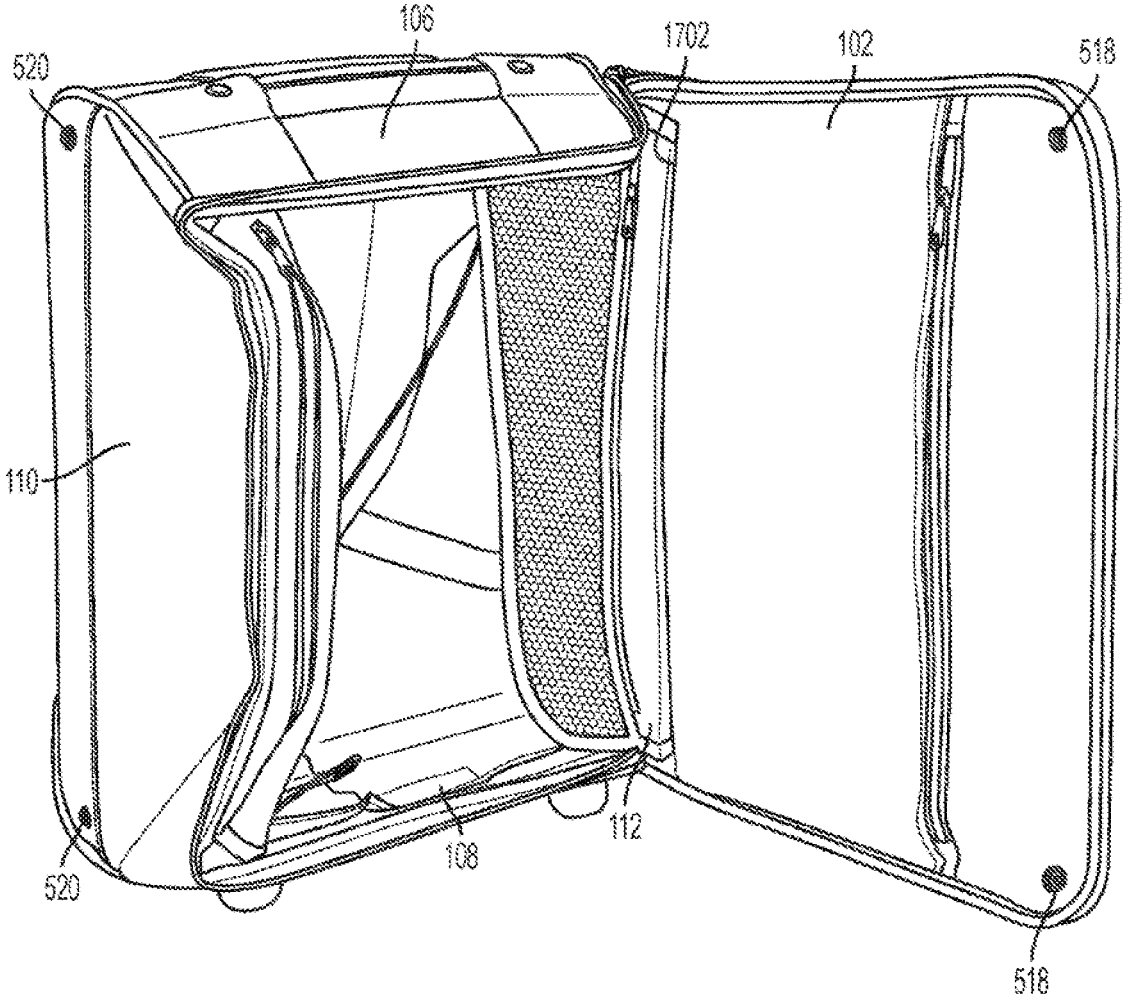
Figure 18:
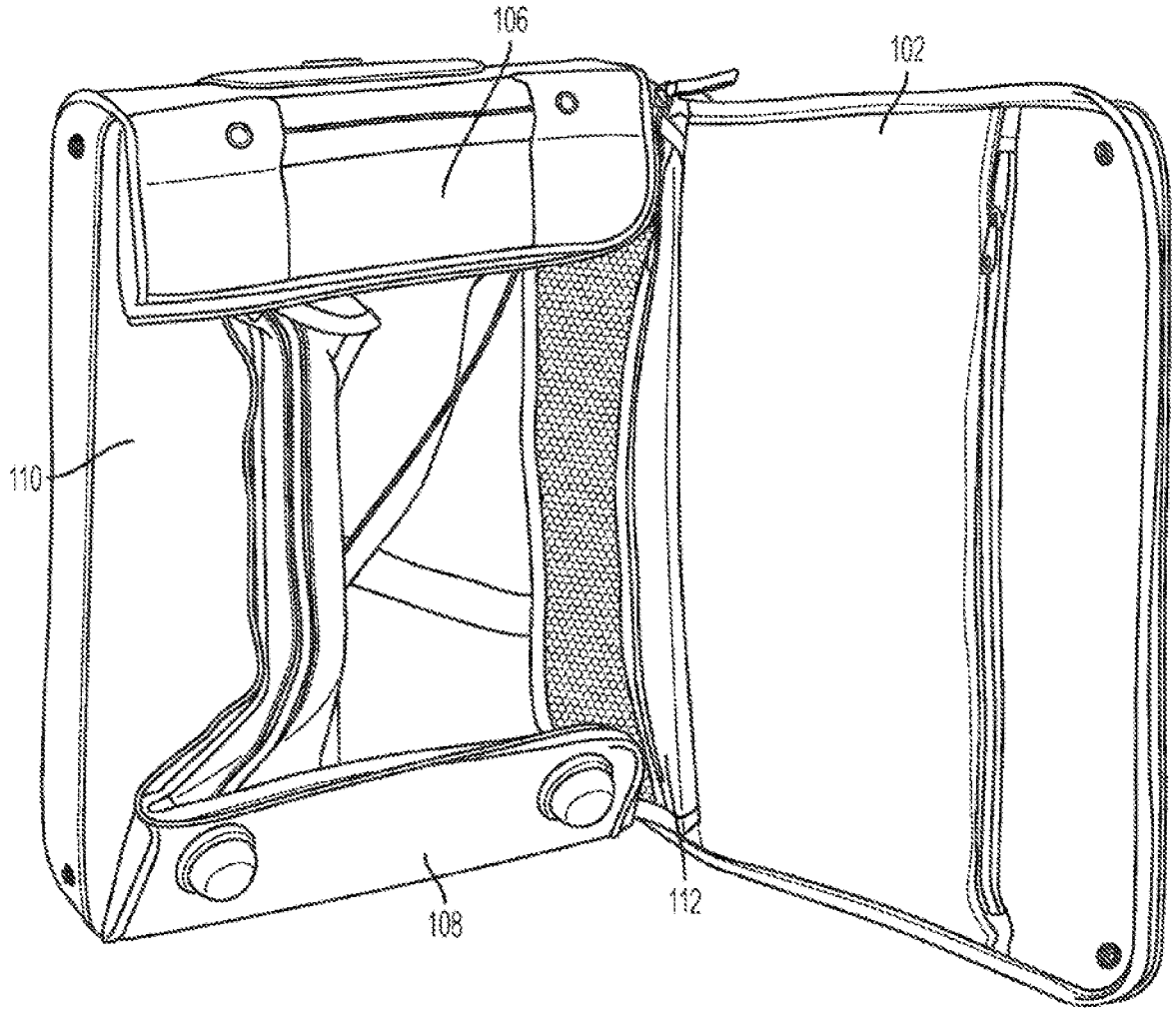

Referring next to FIGS. 9-15, depicts is the corner shown in FIG. 5 as collapsible luggage 100 is caused to collapse (as shown in FIGS. 1A-4B). As shown in FIG. 9, pushing side 112 inward in the direction of arrow A causes first connector 518 to become disconnected from second connector 520.

Further, this also causes a portion of fabric cover 508 not connected to panel 506 to bend in direction of arrow B about diagonal seam 514.

As depicted in FIGS. 9-14, as side 112 is pushed further inward and downward in the direction of arrow A, fabric cover 508 not attached to triangular end 516 folds back over itself along diagonal seam 514 and exerts a pulling force on seam 134, causing side 106 to also be pulled downward in direction of arrow C on top of side 112. The corner is shown fully collapsed in FIG. 15 with side 106 resting on top of side 112. As already described, all four corners of collapsible luggage 100 fold in the same manner as the corner depicted in FIGS. 9-15.

FIGS. 16-19 depict an alternate embodiment of luggage 100 in which the cover 102 is attached to side 112 instead of side 108. In this embodiment, the seam connecting sides 106 & 110 and 108 & 110 is substantially similar to that depicted in FIG. 5. That is, in this embodiment, only side 110 has pane 506 with two triangular ends 516 that are exposed. Side 112 is connected to sides 106 and 108 via zipper 130. Zipper 130 here forms the seam connecting sides 112 and 106 and side 108 to 112 as cover 102 is zippered to close collapsible luggage 100. Thus, in this embodiment, side 112 does not necessarily require an internal panel and can be thought of as an extension of cover 102. However, in order to maintain the rigidity of collapsible luggage 100 in the opened position, it is preferable that side 112 does contain an internal panel similar to that of sides 106 and 108.

Figure 19:
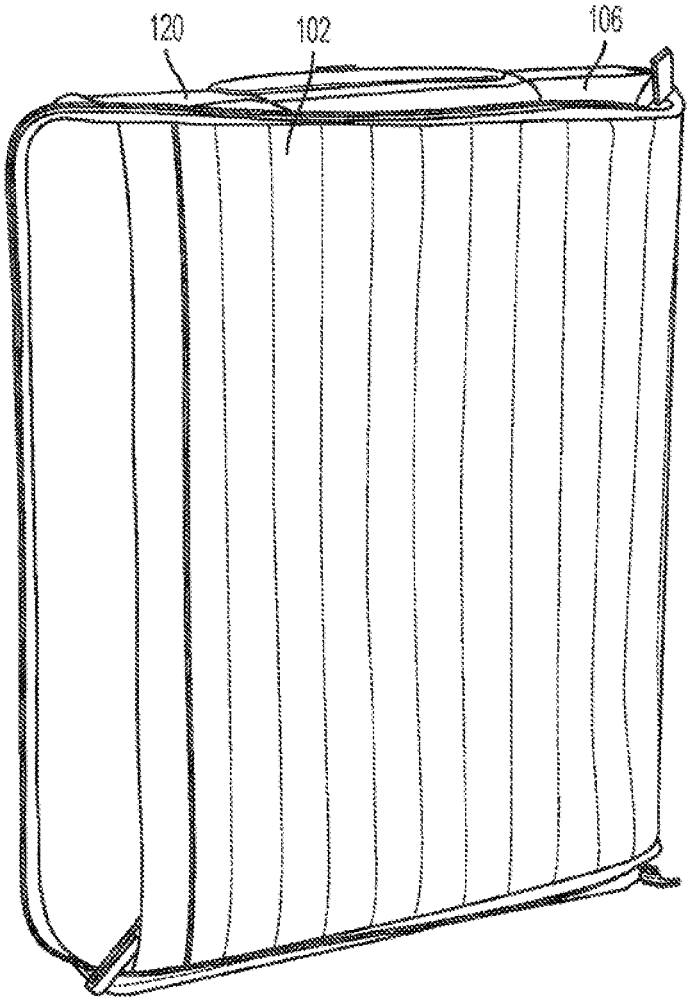

In this embodiment, collapsible luggage 100 is collapsed by first exerting a force on side 110 toward a center of collapsible luggage 100. This causes sides 106 and 108 to fold downward on top of side 110 as is successively illustrated in FIGS. 17-18. Next, side 112 is folded downward over sides 106 and 108 along hinge 1702 which joins cover 102 to side 112. The folding of side 112 allows cover 102 to extend over sidewall 126 so that first connectors 518 and second connectors 520 can mate to secure collapsible luggage 100 in the collapsed position as shown in FIG. 19.

The invention claimed is:

1. A piece of collapsible luggage comprising:

a base portion, wherein the base portion is square or rectangular in shape;

a first side extending upward from the base portion and rotatably coupled to the base portion by first coupling means;

a second side extending upward from the base portion and rotatably coupled to the base portion by second coupling means;

a third side extending upward from the base portion and rotatably coupled to the base portion by third coupling means;

wherein the first side is coupled to the second side at a first end of the first side, wherein the first side is coupled to the third side at a second end of the first side; and a first panel partially coupled to an interior of the first side;

wherein only a first triangular end of the panel located proximal the first end of the first side and a second triangular end of the panel located proximal the second end of the first side are not coupled to the interior of the first side, wherein the first panel is rectangular in shape, wherein the first panel has a length extending substantially from the first end of the first side to the second end of the first side, wherein the first triangular end is formed by a diagonal seam between the first side and the first panel, and wherein the diagonal seam extends from a bottom portion of the first end to a top portion along the length of the first panel.

2. The piece of collapsible luggage according to claim 1, wherein the first triangular end and the second triangular end are equal in size.

3. The piece of collapsible luggage according to claim 1, wherein the second side further comprises:

a second panel located within an interior of the second side, wherein the second panel is substantially a same size as the second side.

4. The piece of collapsible luggage according to claim 1, wherein the first panel is formed from a semi-rigid plastic or carbon board.

5. The piece of collapsible luggage according to claim 1, further comprising:

a fourth side extending upward from the base portion and rotatably coupled to the base portion via fourth coupling means; and a cover coupled to the fourth side along a top edge of the fourth side.

6. The piece of collapsible luggage according to claim 5, wherein a first set of zipper teeth are arranged around at least three sides of the cover; and wherein a second set of zipper teeth are arranged along a first top edge of the first side, a second top edge of the second side, and a third top edge of the third side.

7. The piece of collapsible luggage according to claim 6, wherein the first set of zipper teeth are coupled to the second set of zippered teeth by a zipper to maintain the collapsible luggage in an open position.

8. The piece of collapsible luggage according to claim 5, wherein the base portion further comprises:

a sidewall extending upward from a periphery of the base portion;

wherein the first side is rotatably coupled to the sidewall via the first coupling means, the second side is rotatably coupled to the sidewall via the second coupling means, the third side is rotatably coupled to the sidewall via the third coupling means, and the fourth side is rotatably coupled to the sidewall via the fourth coupling means.

9. The piece of collapsible luggage according to claim 8, wherein, when the first side, the second side, the third side, and the fourth side are rotated towards a center of the collapsible luggage, a first set of connectors located on an interior of the cover mate with a second set of connectors located on an edge of the sidewall to maintain the collapsible luggage in a collapsed position.

10. The piece of collapsible luggage according to claim 9, wherein at least one of the first side, the second side, the third side, or the fourth side comprises a hanger loop.

11. The piece of collapsible luggage according to claim 1, wherein an exterior surface of the first triangular end comprises a first connector configured to mate with a second connector located on an interior of the first side at a location where the first triangular end is not coupled to the interior of the first side.

12. The piece of collapsible luggage according to claim 11, wherein the first connector and the second connector mate using a button coupling or a hook-and-loop fastener coupling.

13. A piece of collapsible luggage comprising:

a base portion, wherein the base portion is square or rectangular in shape;

a first side extending upward from the base portion and rotatably coupled to the base portion by first coupling means;

a second side extending upward from the base portion and rotatably coupled to the base portion by second coupling means;

a third side extending upward from the base portion and rotatably coupled to the base portion by third coupling means;

wherein the first side is coupled to the second side at a first end of the first side, wherein the first side is coupled to the third side at a second end of the first side;

a first panel partially coupled to an interior of the first side, wherein only a first triangular end of the panel located proximal the first end of the first side and a second triangular end of the panel located proximal the second end of the first side are not coupled to the interior of the first side;

a fourth side extending upward from the base portion and rotatably coupled to the base portion; and a cover coupled to the fourth side along a top edge of the fourth side, wherein the base portion further comprises:

a sidewall extending upward from a periphery of the base portion;

wherein the first side, the second side, the third side, and the fourth side are rotatably connected to the sidewall, wherein, when the first side, the second side, the third side, and the fourth side are rotated towards a center of the collapsible luggage, a first set of connectors located on an interior of the cover mate with a second set of connectors located on an edge of the sidewall to maintain the collapsible luggage in a collapsed position, and wherein at least one of the first side, the second side, the third side, or the fourth side comprises a hanger loop.

* * * * *